US006983921B1

(12) United States Patent
Rahmer

(10) Patent No.: US 6,983,921 B1
(45) Date of Patent: Jan. 10, 2006

(54) ROLLING CHRISTMAS TREE STAND

(76) Inventor: Paul G. Rahmer, W4068 Maplewood La., Fond du Lac, WI (US) 54935

( * ) Notice: Subject to any disclaimer, the term of this patent is extended or adjusted under 35 U.S.C. 154(b) by 0 days.

(21) Appl. No.: 10/794,919

(22) Filed: Mar. 8, 2004

(51) Int. Cl.
*F16M 13/00* (2006.01)

(52) U.S. Cl. ..... 248/523; 47/40.5

(58) Field of Classification Search ..... 248/519, 248/521, 523; 47/40.5, 42
See application file for complete search history.

(56) References Cited

U.S. PATENT DOCUMENTS

| | | | | |
|---|---|---|---|---|
| 3,480,241 | A * | 11/1969 | Moyer | 47/40.5 |
| 3,858,270 | A * | 1/1975 | Crowe | 16/19 |
| 5,070,678 | A | 12/1991 | Morrill | 53/549 |
| 5,118,067 | A | 6/1992 | Gillanders | 248/527 |
| 5,301,462 | A * | 4/1994 | Hronyetz | 47/40.5 |
| 5,388,799 | A | 2/1995 | Keefe | 248/519 |
| 5,425,547 | A | 6/1995 | Payan | 280/46 |
| 5,478,042 | A * | 12/1995 | Bliss et al. | 248/523 |
| 5,702,086 | A | 12/1997 | Hunt | 248/519 |
| D400,333 | S | 10/1998 | Westlake | D34/17 |
| 6,070,848 | A * | 6/2000 | Ogren | 248/523 |
| 6,260,335 | B1 | 7/2001 | Helinski | 53/530 |
| D449,415 | S | 10/2001 | Durieux | D34/17 |
| 6,745,991 | B1 * | 6/2004 | Rush | 248/523 |
| 2002/0108301 | A1 * | 8/2002 | Tasker | 47/40.5 |
| 2004/0026594 | A1 * | 2/2004 | Lee | 248/523 |

* cited by examiner

*Primary Examiner*—Ramon O Ramirez
(74) *Attorney, Agent, or Firm*—John D. Gugliotta; P. Jeff Martin; Olen L. York, III

(57) ABSTRACT

A Christmas tree stand is provided with integral, adjustable, and lockable rolling casters. A series of thumb operated bolts hold the tree and a central reservoir to hold water to help the tree remain green. A series of four or five casters are provided around the bottom perimeter of the stand. Each caster is adjustable in height, which allows the user to set the tree straight or plumb.

5 Claims, 3 Drawing Sheets

ROLLING CHRISTMAS TREE STAND

RELATED APPLICATIONS

The present invention was first described in Disclosure Document Number 501,783 filed on Nov. 28, 2001 under 35 U.S.C. §122 and 37 C.F.R. §1.14. There are no currently co-pending applications anywhere in the world.

BACKGROUND OF THE INVENTION

1. Field of the Invention

The present invention relates generally to tree stands that accommodate relocation and the like and, more particularly, to a wheeled, wide, weighted based including a perforated retention sleeve for allowing free communication of fluid to the tree's trunk.

2. Description of the Related Art

The holiday season is a time of great fun and happiness for almost everyone. A great deal of the holiday cheer comes from the yearly traditions that are passed from generation to generation. Perhaps the most well known of all traditions is that of the Christmas tree. The act of putting it up and decorating it in one's home is a process that can be enjoyed by all members of the family. However, the physical size of most Christmas trees, causes a number of aggravations. First, it is difficult to get the tree to be straight and plumb in the stand. Second, the tree must be positioned in its final location before it can be decorated. Third, it is difficult to clean or vacuum around. Finally, the tree often blocks access to shelves, cabinets or other items which may be needed during the holiday season.

A search of the prior art did not disclose any patents that read directly on the claims of the instant invention; however, the following references were considered related:

U.S. Pat. No. 6,260,335 issued in the name of Helinski, describes a Christmas Tree cart comprised of a hollow cylindrical tree holder mounted on wheels.

U.S. Pat. No. 5,702,086 issued in the name of Hunt, describes a new portable tree holding device for creatively and innovatively holding a Christmas tree or the like in a vertical upright position.

U.S. Pat. No. 5,425,547 issued I the name of Payan, describes a Christmas tree spotter for easily and safely moving a fully decorated erect Christmas tree to a display location.

U.S. Pat. No. 5,388,799 issued in the name of Keefe, describes an apparatus for supporting and transporting a Christmas tree.

U.S. Pat. No. 5,118,067 issued in the name of Gillanders, describes a holder for Christmas trees which provides for ease of mobility with wheels and a removable handle.

U.S. Pat. No. 5,070,678 issued in the name of Morrill, describes a upright frame member with an upper handle and bottom support wheels. The forward projecting boom is secured to the upright frame and is of length at least as long as tree branched to be mounted on the cart.

U.S. Patent No. D449, 415 issued in the name of Durieux, is an ornamental design for a handcart.

U.S. Patent No. D400, 333 issued in the name of Westlake, is an ornamental design for a Christmas tree transport cart.

Consequently, there is a need for a means by which Christmas trees can be easily moved while in an upright position to reduce or eliminate the aggravations as described above.

SUMMARY OF THE INVENTION

It is therefore an object of the present invention to provide an improved tree stand that accommodates relocation.

It is a feature of the present invention to provide an improved a wheeled, wide, weighted based including a perforated retention sleeve for allowing free communication of fluid to the tree's trunk.

Briefly described according to one embodiment of the present invention, a Christmas tree stand is provided with integral, adjustable, and lockable rolling casters. Upon initial observation of the invention, it looks like a conventional Christmas tree stand with a series of thumb operated bolts to hold the tree and a central reservoir to hold water to help the tree remain green. However, after closer inspection, it can be seen that a series of four or five casters are provided around the bottom perimeter of the stand. Each caster is adjustable in height, which allows the user to set the tree straight or plumb.

Additionally, each caster is lockable, which aids in keeping the tree stationary and stable when movement is not desired. With such a system, the tree can be easily moved during initial placement, during decorating, for cleaning or vacuuming, for access behind the tree, and for removal purposes.

The use of the present invention allows an upright Christmas tree to be moved in a quick, safe, easy and effective manner.

Advantages of the present invention are that it can be used to holds live Christmas trees or, alternatively, can be used with artificial trees as well.

Further, the present invention has multiple uses, such as: allowing a tree to be easily moved when initially putting up the tree; allowing a tree to be moved or rotated for even and consistent decorating; moving a tree for cleaning, sweeping or vacuuming; moving a tree for access to blocked cabinets, shelves or other items; or, permitting easy decoration removal after completion of holiday season.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
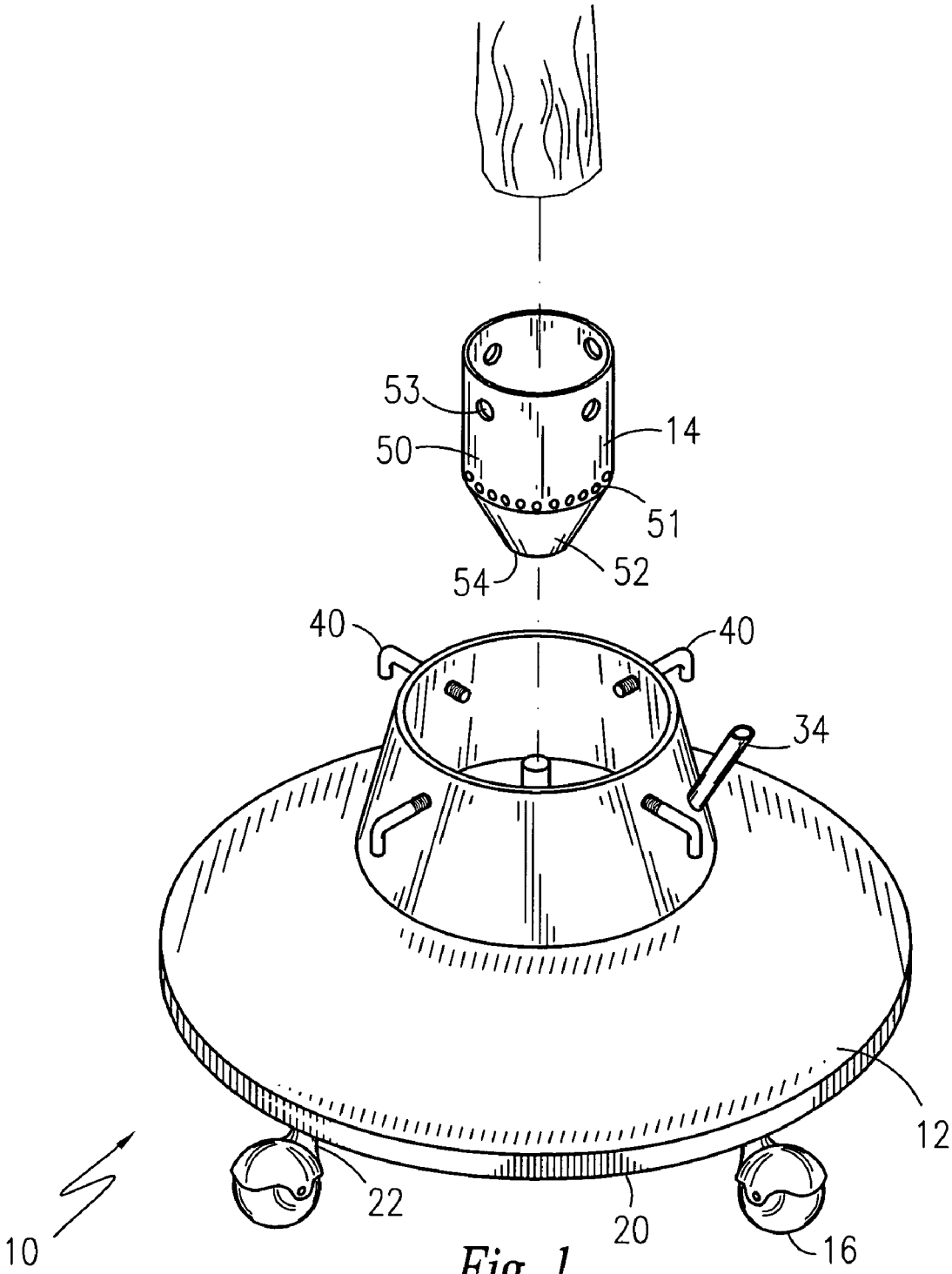
FIG. 1 is a partially exploded perspective view of a Christmas tree stand according to the preferred embodiment of the present invention.
Figure 2:
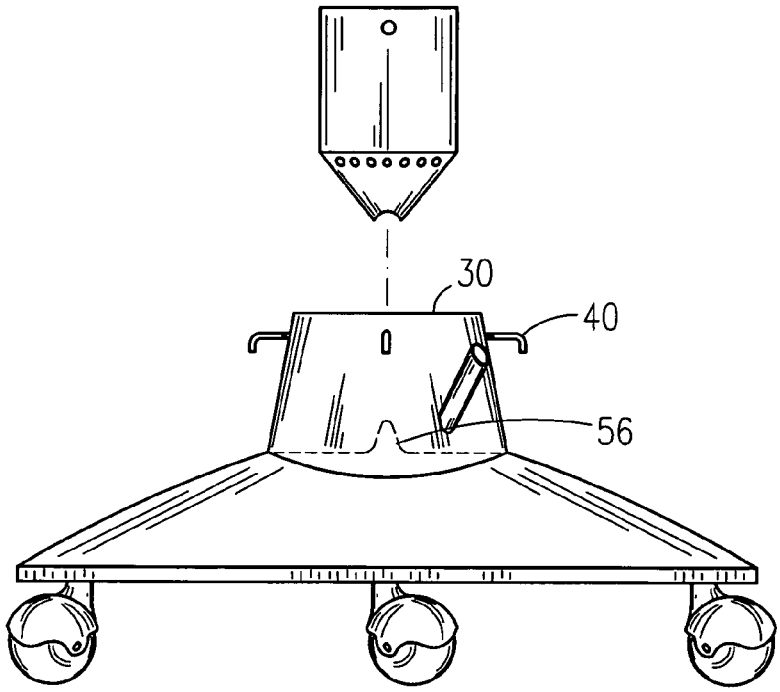
FIG. 2 is a side elevational view thereof.
Figure 3:
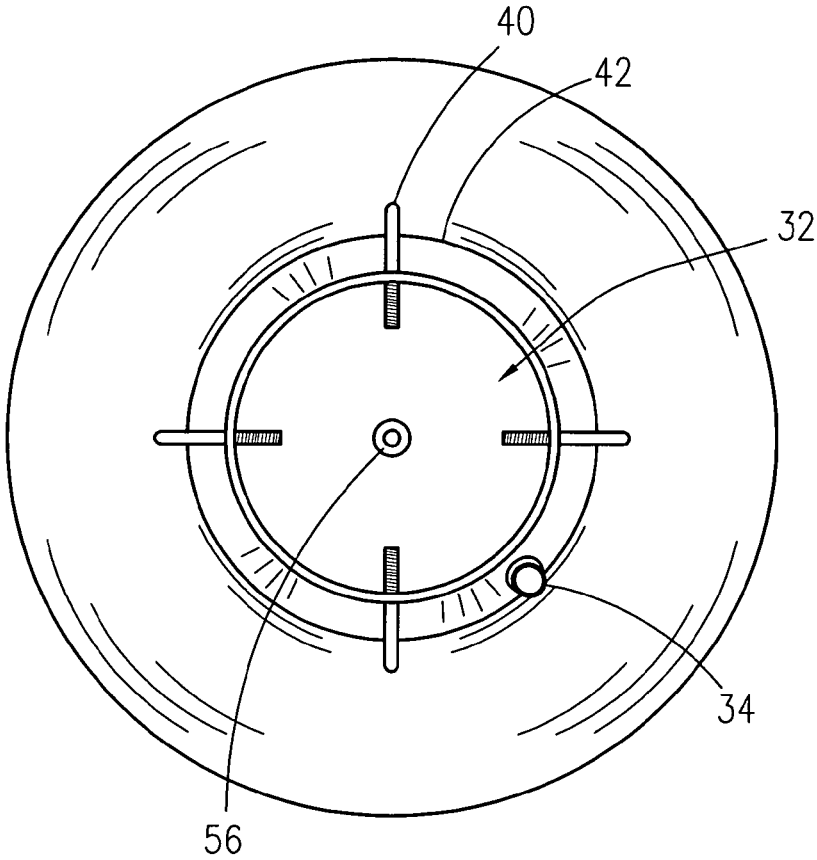
FIG. 3 is a top plan view thereof.

Referring now to FIGS. 1–3, a tree support apparatus 10 is shown, according to the present invention, including a radially configured base 12 an a removable, insertable perforated retention sleeve 14. The tree support 10 is provided with a plurality of adjustable and lockable rolling casters 16. A series of four or five casters 16 are provided around the bottom perimeter 20 of the stand 10. Each caster 16 is adjustable in height by use of a threaded, linearly articulating attachment rod 22, which allows the user to set the tree straight or plumb.

Additionally, each caster 16 is lockable, which aids in keeping the tree stationary and stable when movement is not desired. With such a system, the tree can be easily moved during initial placement, during decorating, for cleaning or vacuuming, for access behind the tree, and for removal purposes.

The upper portion of the stand 10 forms an integral cylindrical receiving basin 30 forming an integral water-tight containment 32. A water introduction means 34, through which water may be poured into the water-tight containment 32, and shown herein as a cylindrical introduction tube, is in fluid communication with the water-tight containment 32. About the upper perimeter of the cylindrical receiving basin 30 are a series of impingement rods 40, each having a threaded inner end opposite an angular outer end, wherein the impingement rods 40 are each received by a tapped outer receiving orifice 42.

Finally, the perforated retention sleeve 14 is formed having a cylindrical upper portion 50 and terminating at a generally cone-shaped lower portion 52. The upper portion 50 forms tapped_inner 53 receiving orifices that allow the impingement rods 40 to penetrate and impinge against the trunk of an inserted tree. The lower portion 52 forms a plurality of perforations 51 and terminates at an apex that forms a centering aperture 54. The centering aperture 54 aligns with a centering pin 56 projecting vertically upward from the bottom of the basin 30.

2. Operation of the Preferred Embodiment

To use the present invention, a user first places the trunk of a tree into the perforated retention sleeve 14. The perforated retention sleeve is then placed within the basin 32 such that the centering aperture 54 receives the centering pin 56. The threaded rods 40 are then tightened until the tree is securely held in place in a vertical, straight manner. If any final "trimming" of the level of the tree is necessary, the appropriate castors 16 can thereby be adjusted. If a live-cut tree is being held, water can be introduced to the basin via the water introduction means 34.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A tree support apparatus comprising:

a radially configured base having an upper portion forming an integral cylindrical receiving basin and an integral water-tight containment;

a removable, insertable perforated retention sleeve, said retention sleeve receiving a tree and insertable into said receiving basin, said perforations permitting uptake of water delivery to said tree;

a centering pin, said centering pin projecting vertically upward from a bottom of said receiving basin for removably receiving said retention sleeve;

a plurality of adjustable and lockable rolling casters provided around a bottom perimeter of said base, wherein each caster is adjustable in height by use of a threaded, linearly articulating attachment rod, which allows the user to set the tree straight or plumb; and water introduction means in fluid communication with said water-tight containment, said water introduction means allowing for addition of water to said water-tight containment without removal of said water introduction means and said retention sleeve.

2. The tree support apparatus of claim 1, wherein each caster is lockable.

3. The tree support apparatus of claim 1, wherein about an upper perimeter of said cylindrical receiving basin are a series of impingement rods, each said impingement rod having a threaded inner end opposite an angular outer end, said impingement rods are each received by a tapped outer receiving orifice.

4. The tree support apparatus of claim 1, wherein said perforated retention sleeve is formed having a cylindrical upper portion and terminates at a generally cone-shaped lower portion, said cylindrical upper portion forms tapped outer receiving orifices that allow impingement rods to penetrate and impinge against the trunk of an inserted tree.

5. The tree support apparatus of claim 4, wherein said cone-shaped lower portion forms a plurality of perforations and terminates at an apex that forms a centering aperture, said centering aperture aligns with said centering pin projecting vertically upward from the bottom of said basin.

* * * * *